US006786797B1

(12) United States Patent
Cheng

(10) Patent No.: US 6,786,797 B1
(45) Date of Patent: Sep. 7, 2004

(54) DOUBLE LAYER BLOCKS CAPABLE OF TURNING ENDLESSLY

(76) Inventor: I-Fen Cheng, 3F, No. 157-3, Chiu Kang Street, Mucha, Taipei (TW)

( * ) Notice: Subject to any disclaimer, the term of this patent is extended or adjusted under 35 U.S.C. 154(b) by 0 days.

(21) Appl. No.: 10/715,480

(22) Filed: Nov. 19, 2003

(51) Int. Cl.[7] ..... A63H 33/00

(52) U.S. Cl. ..... 446/487; 273/153 S

(58) Field of Search ..... 446/487; 273/153 S, 273/153 R; 434/406, 402, 211

(56) References Cited

U.S. PATENT DOCUMENTS 4,667,961 A * 5/1987 Abu-Shumays et al. . 273/153 S
4,978,126 A * 12/1990 Morosow et al. ..... 273/153 S
5,193,809 A * 3/1993 Hrsel et al. ..... 273/153 S
5,785,318 A * 7/1998 Nesis ..... 273/153 S

* cited by examiner

*Primary Examiner*—Jacob K. Ackun
*Assistant Examiner*—Bena Miller
(74) *Attorney, Agent, or Firm*—Rabin & Berdo, P.C.

(57) ABSTRACT

Disclosed is a double layer block assembly comprising four single layer blocks, two first double layer blocks, two second double layer blocks, four outer stickers, and four inner stickers. An upper layer section of the assembly comprises two single layer blocks, two upper layers of two first double layer blocks, and two upper layers of two second double layer blocks. A lower layer section of the assembly comprises the other two single layer blocks, two lower layers of two first double layer blocks, and two lower layers of two second double layer blocks. The outer stickers are adhered to top and bottom surfaces of the assembly. The inner stickers are adhered between the upper and lower layer sections so that the assembly is able to turn about two parallel axes endlessly. A variety of shapes and colorful patterns for advertisement can be thus formed.

13 Claims, 13 Drawing Sheets

DOUBLE LAYER BLOCKS CAPABLE OF TURNING ENDLESSLY

BACKGROUND OF THE INVENTION

1. Field of the Invention

The present invention relates to magic balls and more particularly to a double layer block structure in which the blocks are capable of turning endlessly for forming one of different shapes.

2. Description of Related Art

A conventional magic ball comprises a plurality of small cubic blocks. The drawbacks of the prior magic ball are monotony, complexity, being difficult to disassemble and reassemble after use, and lack of entertainment. Thus, it is desirable to provide a novel, highly entertaining double layer block structure so as to either bring more fun to users or be applicable to advertisement.

SUMMARY OF THE INVENTION

It is an object of the present invention to provide a double layer block assembly comprising four single layer blocks, two first double layer blocks, two second double layer blocks, four outer stickers, and four inner stickers wherein an upper layer section of the assembly comprises two single layer blocks, two upper layers of two first double layer blocks, and two upper layers of two second double layer blocks; a lower layer section of the assembly comprises the other two single layer blocks, two lower layers of two first double layer blocks, and two lower layers of two second double layer blocks; the outer stickers are adhered to a top and a bottom surfaces of the assembly; and the inner stickers are adhered between the upper layer section and the lower layer section of the assembly so that the assembly is operative to turn about two parallel axes repeatedly. By utilizing the present invention, a variety of shapes and colorful patterns for advertisement also can be formed.

The above and other objects, features and advantages of the present invention will become apparent from the following detailed description taken with the accompanying drawings.

DETAILED DESCRIPTION OF THE PREFERRED EMBODIMENTS

Figure 1A:
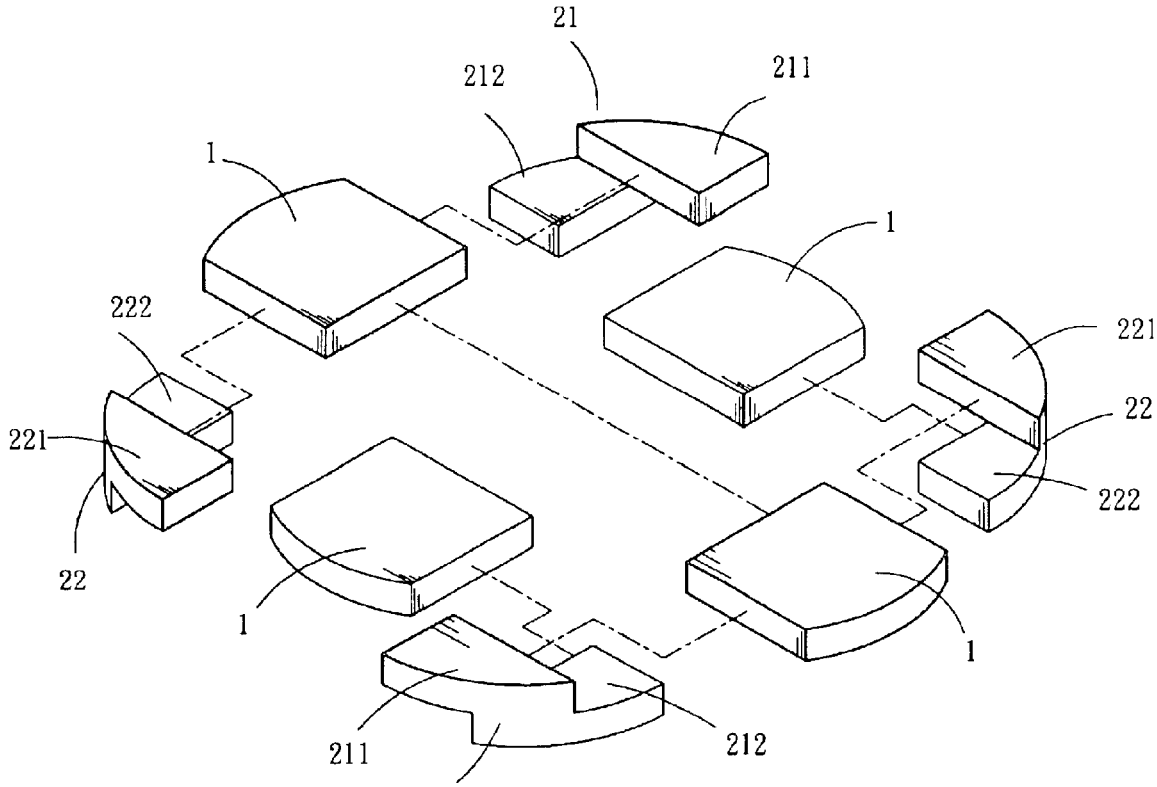
FIGS. 1*a*, 1*b*, 1*c*, 1*d*, 1*e*, 1*f*, 1*g*, and 1*h* are exploded views of a first preferred embodiment of double layer block structure according to the invention for illustrating first, second, third, fourth, fifth, sixth, seventh, and eighth shapes thereof respectively.
Figure 2A:
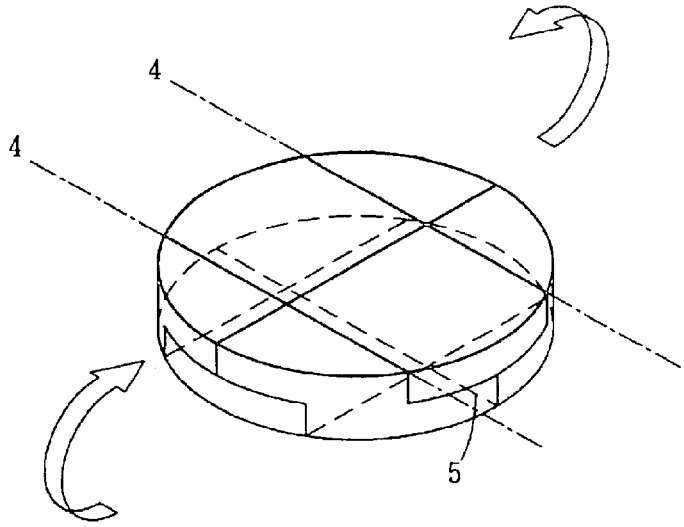
FIGS. 2*a*, 2*b*, 2*c*, 2*d*, 2*e*, 2*f*, 2*g*, and 2*h* are perspective views of the assembled structure shown in FIGS. 1*a* to 1*h* respectively.
Figure 1B:
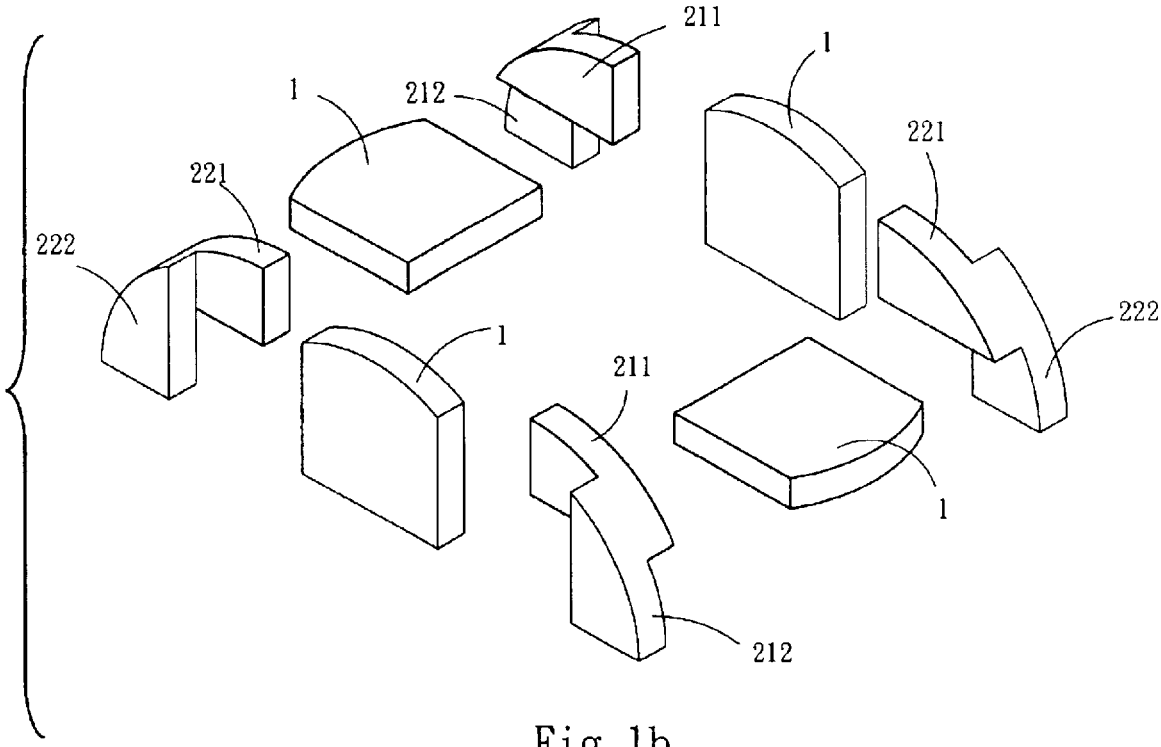
Figure 2B:
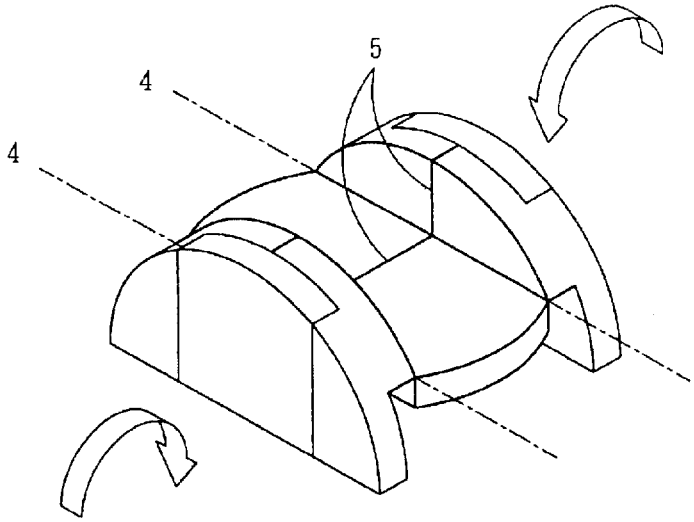
Figure 1C:
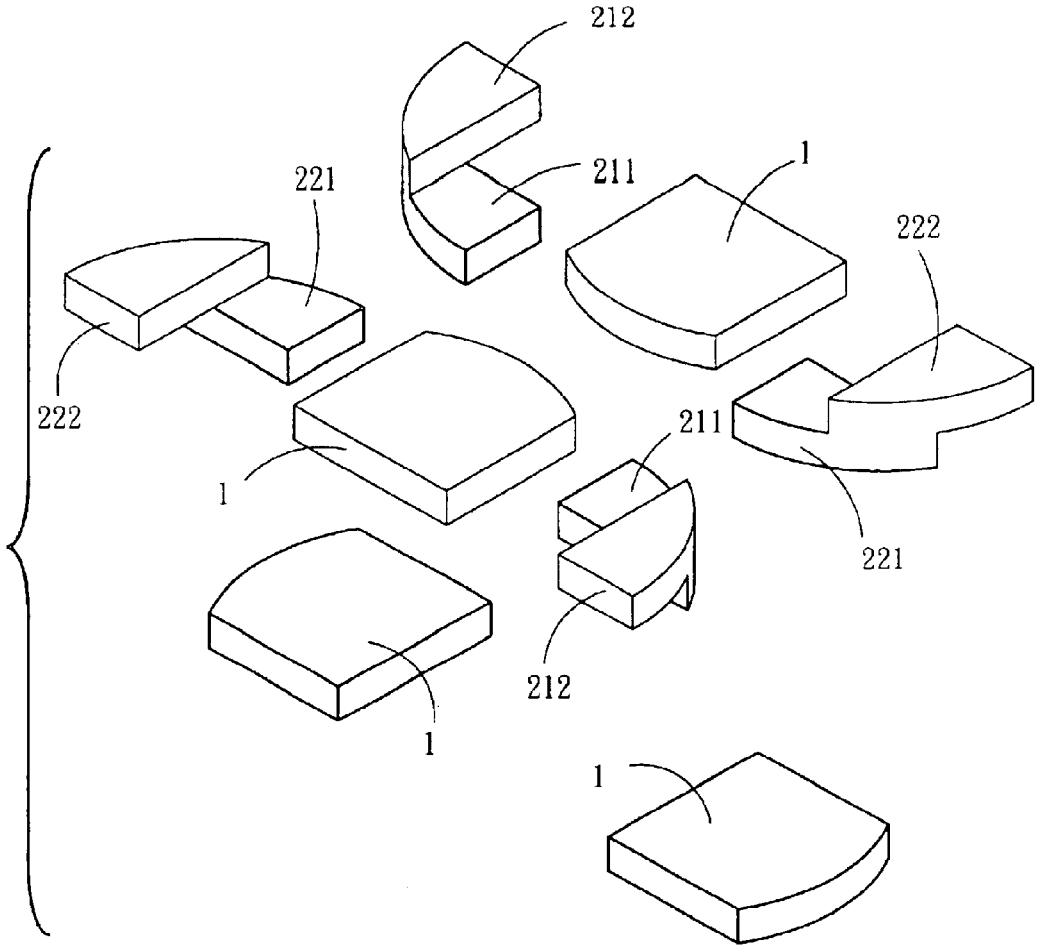
Figure 2C:
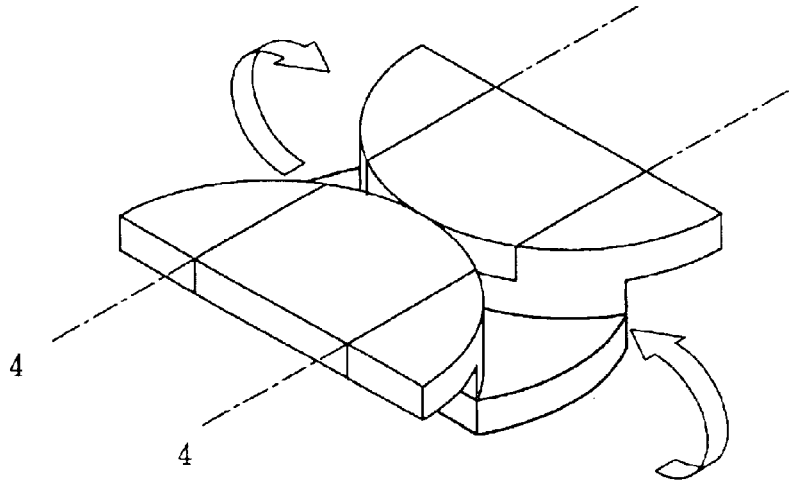
Figure 1D:
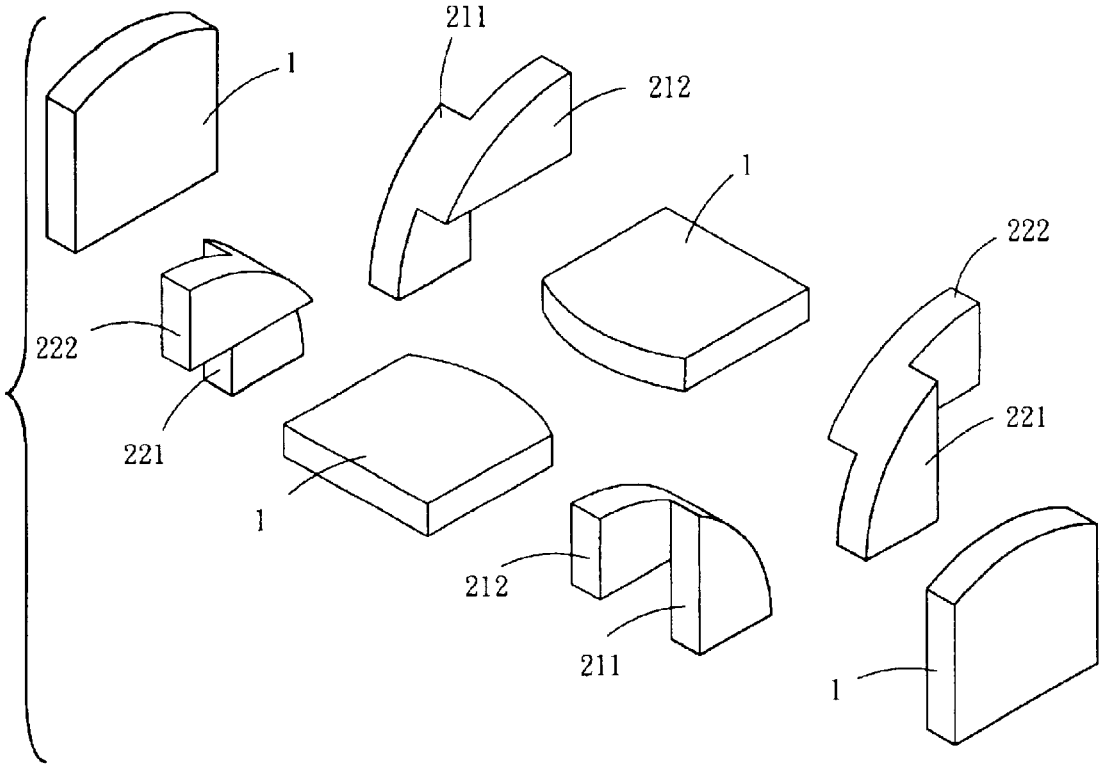
Figure 2D:
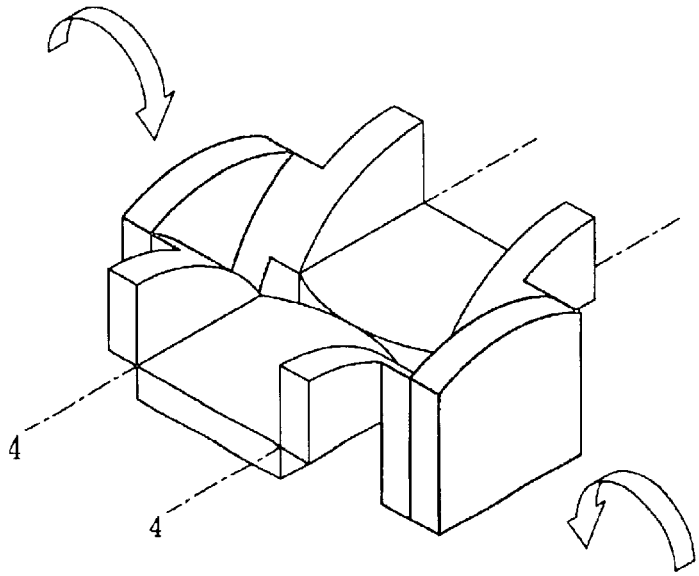
Figure 1E:
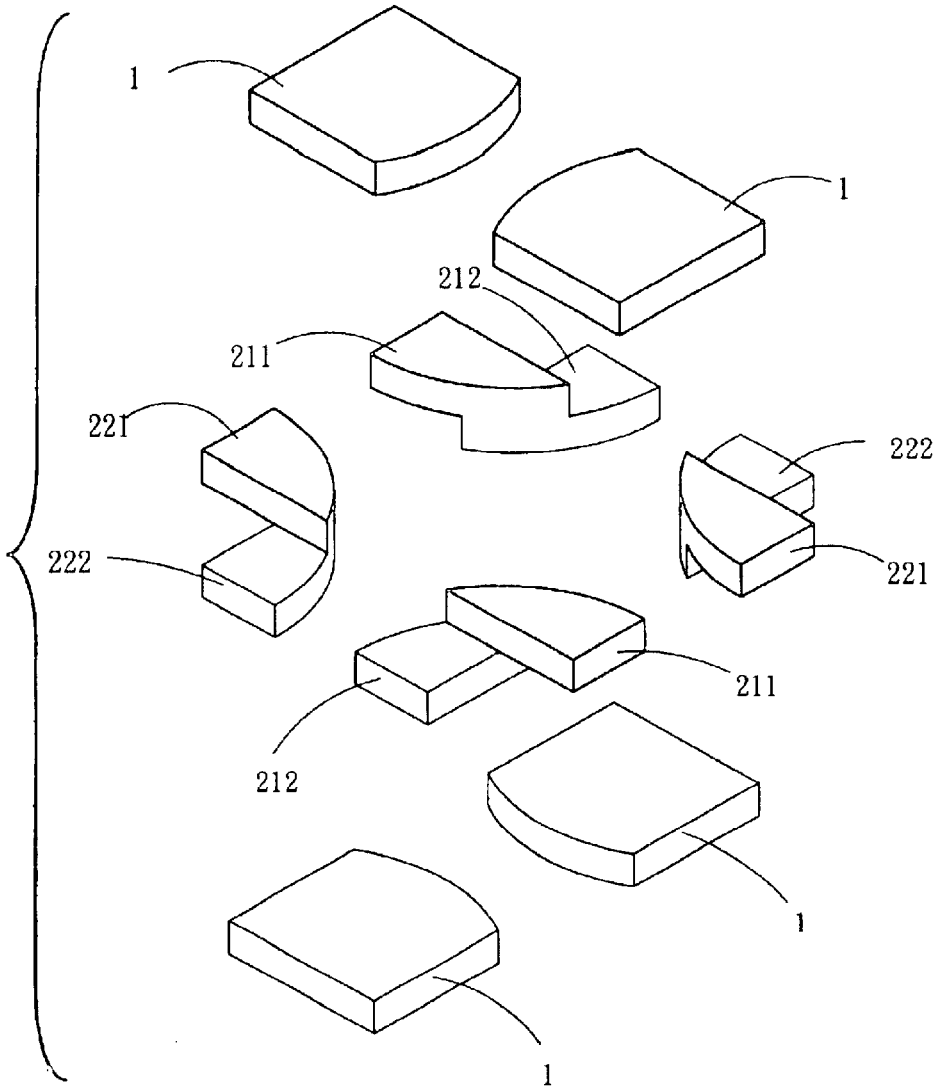
Figure 2E:
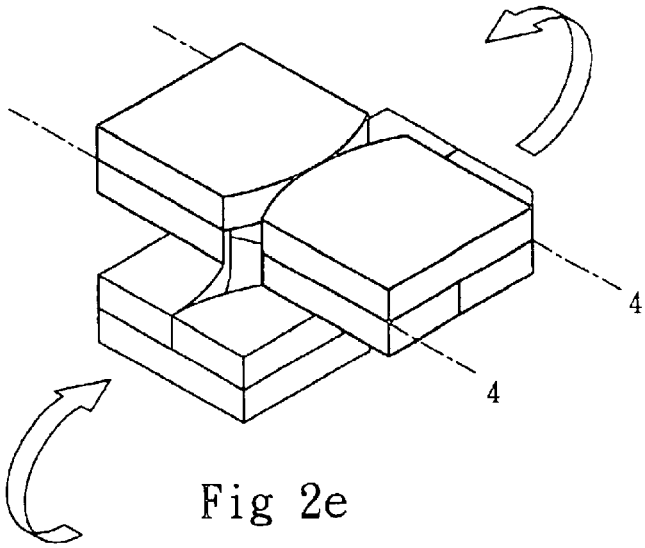
Figure 1F:
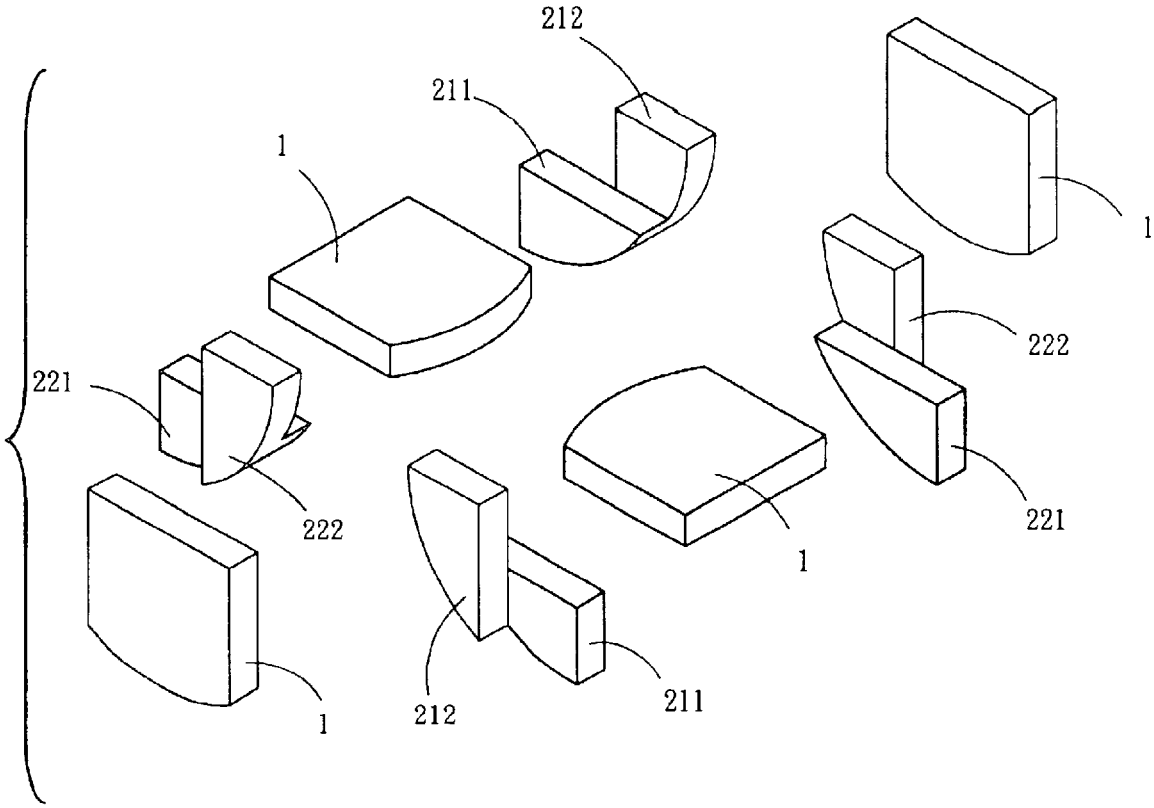
Figure 2F:
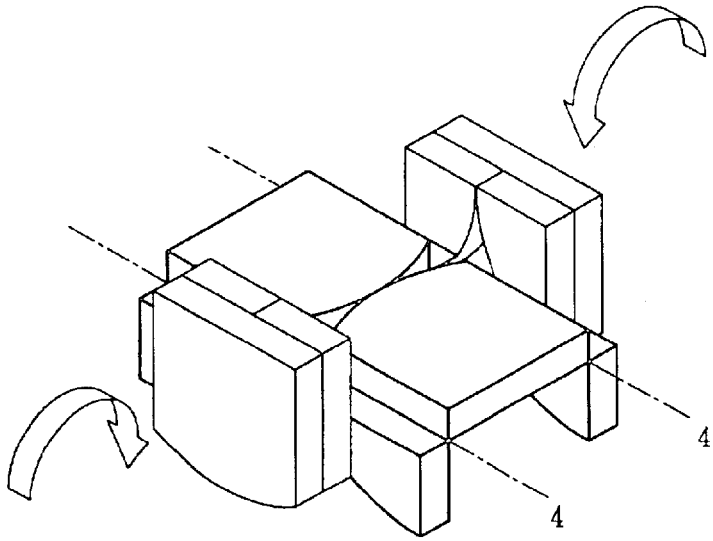
Figure 1G:
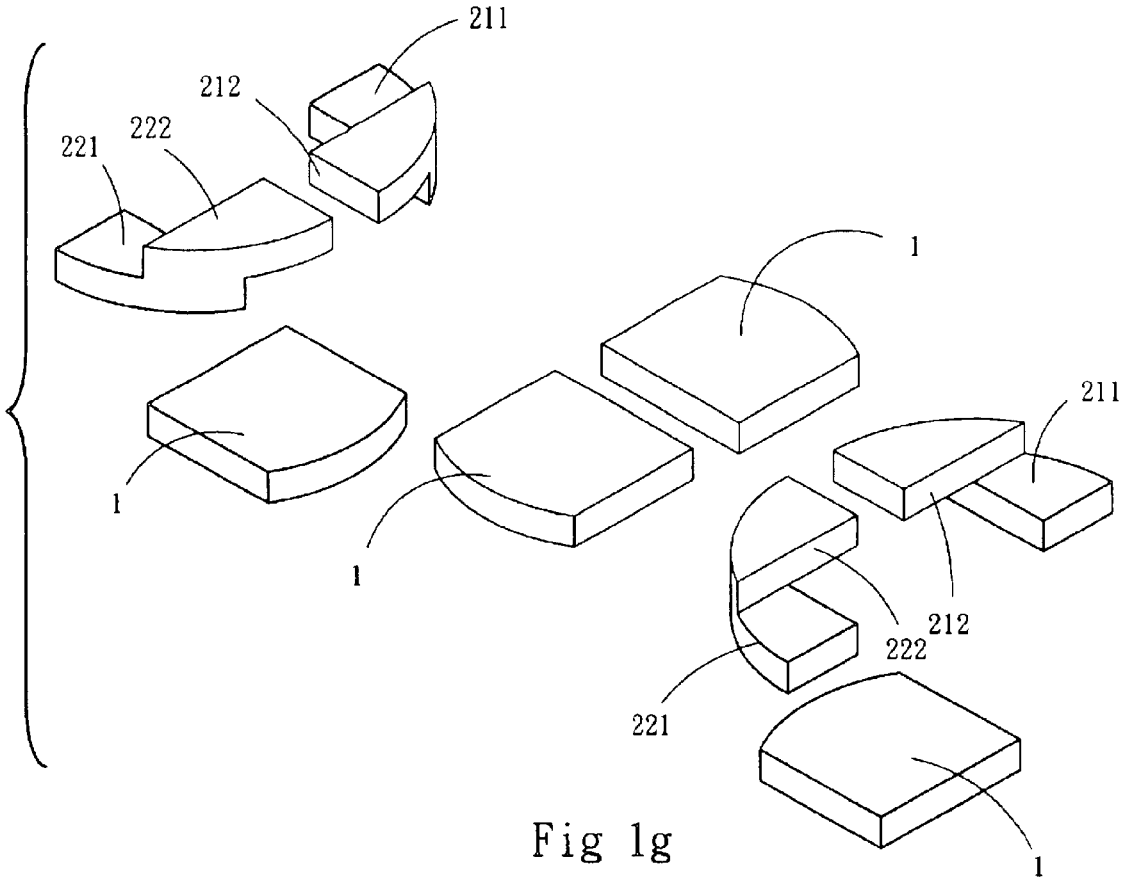
Figure 2G:
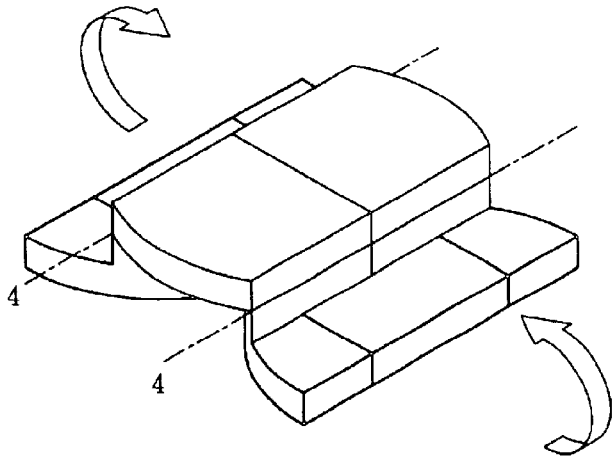
Figure 1H:
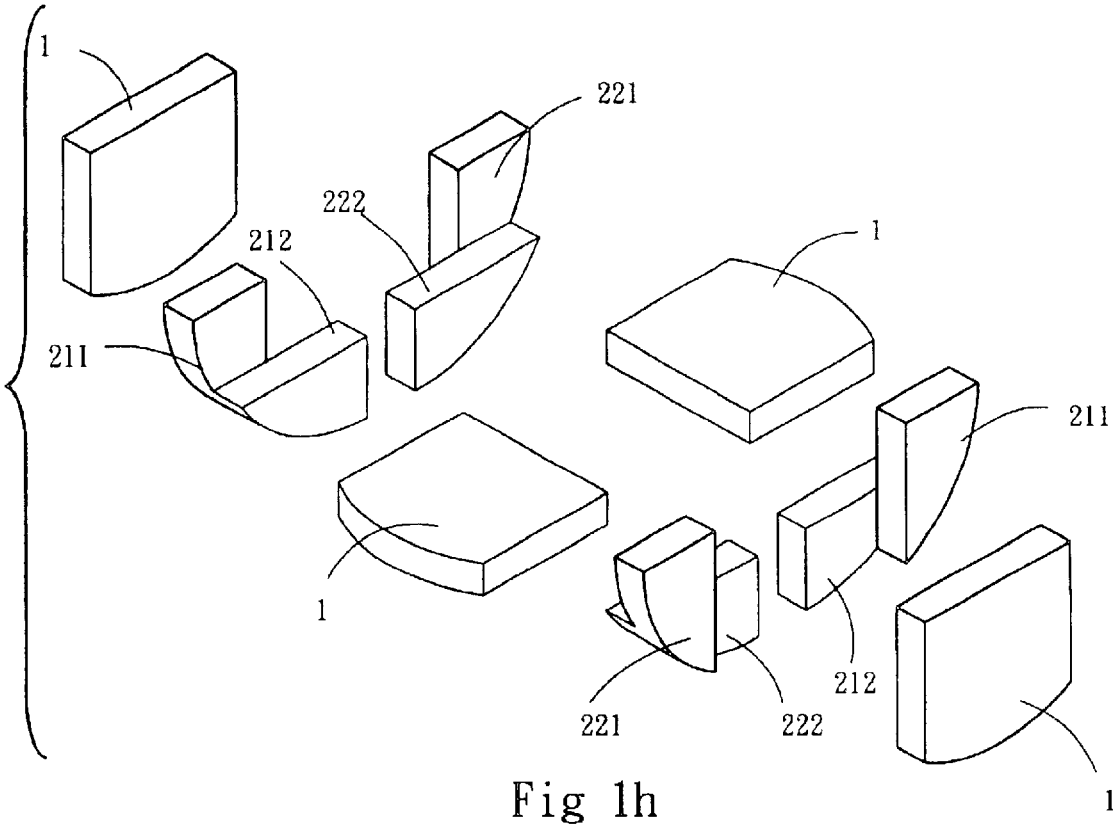
Figure 2H:
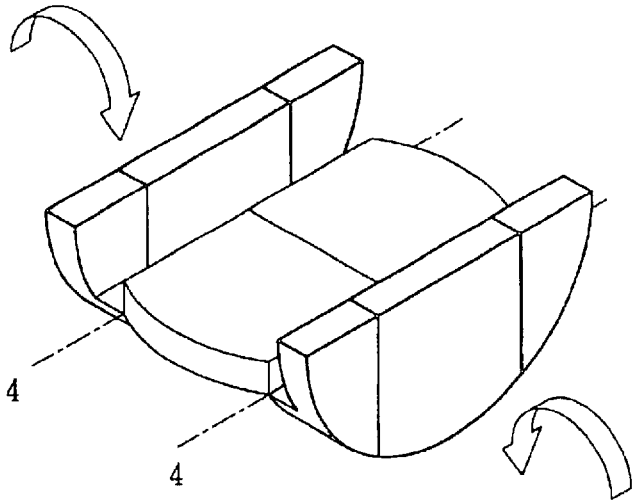
Figure 3:
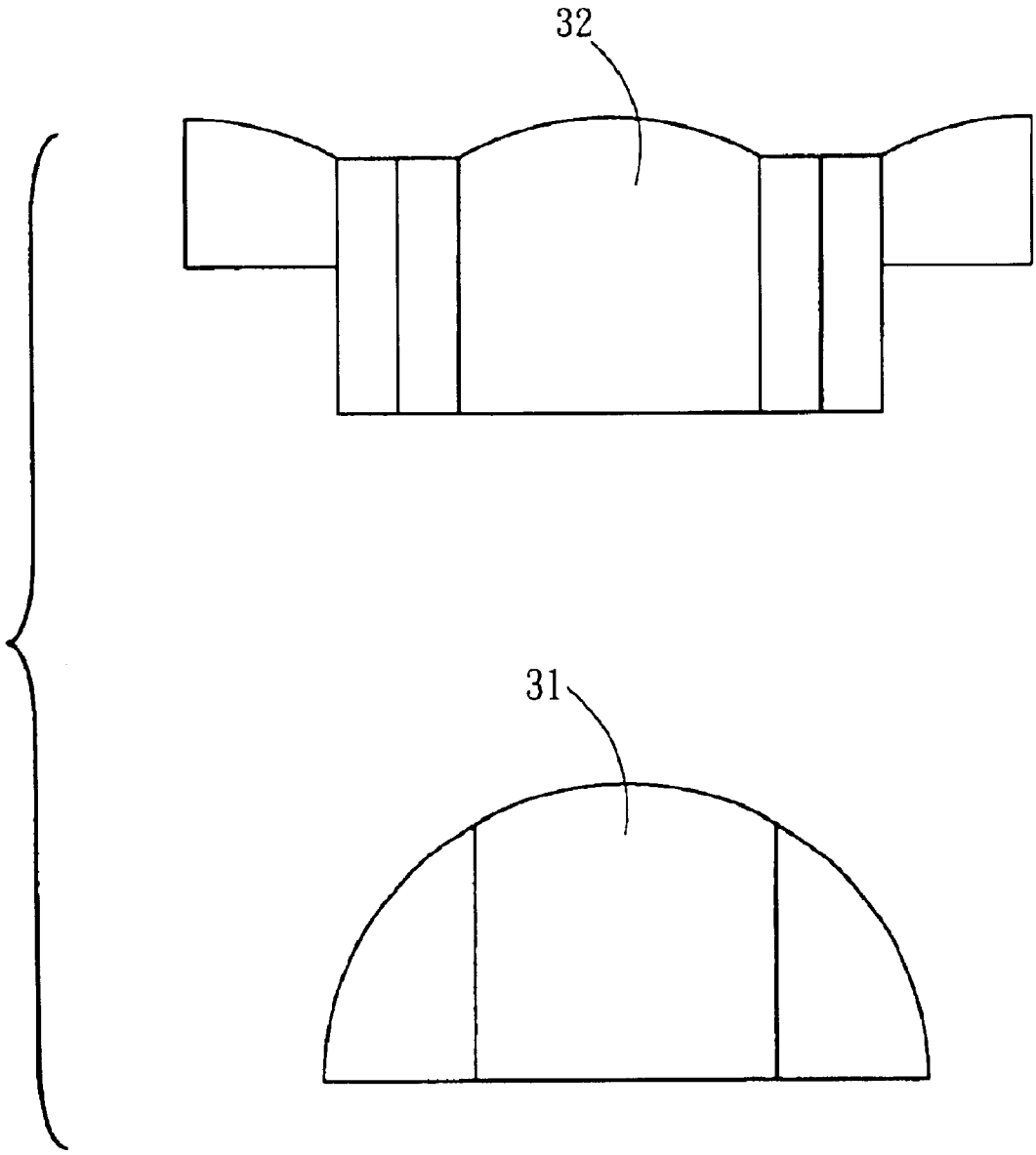
FIG. 3 is a plan view of an expanded sticker according to the first preferred embodiment of the invention.

Referring to FIGS. 1*a*, 2*a*, 3, and 5*a*, there is shown a double layer block structure constructed in accordance with the invention. The original structure is a disc. The structure comprises four single layer blocks 1, two first double layer blocks 21, two second double layer blocks 22, four outer stickers 31, and four inner stickers 32. An upper layer section of the structure comprises two single layer blocks 1, two upper layers 211 of two first double layer blocks 21, and two upper layers 221 of two second double layer blocks 22. A lower layer section of the structure comprises the other two single layer blocks 1, two lower layers 212 of two first double layer blocks 21, and two lower layers 222 of two second double layer blocks 22. The outer stickers 31 are adhered to the top and bottom surfaces of the structure. The inner stickers 32 are adhered between the upper layer section and the lower layer section of the structure. FIG. 2*a* is a perspective view of the assembled structure in the first shape. The structure is able to upwardly turn either about two parallel axes 4 on the top surface or about two axes 4 on the bottom surface (as detailed later) since the outer stickers 31 are adhered to the top and bottom surfaces of the structure. The single layer blocks 1 of the lower layer section turn from a folded line 5 perpendicular to the axes 4 to form as a second shape as the first double layer blocks 21 and the second double layer blocks 22 turn about axes 4 respectively (see FIG. 2*b*). The axes 4 of the upper layer section and the lower layer section can be seen in the second shape. However, it is impossible to divide the structure into two portions from the folded line 5 opposite the axes 4 if the structure is turned about the axis 4 in the lower layer section. That is, it is only allowed to turn about the axis 4 in the upper layer section to form as a third shape (see FIG. 2*c*). Next, it is possible to change the axis 4 to form as a fourth, fifth, sixth, seventh, or eighth shape (see FIGS. 2*d* to 2*h*). The structure can change from the first shape to the eighth shape directly by turning. This is best illustrated in FIGS. 1*a* to 1*h*, which are exploded views of a first preferred embodiment of double layer block structure according to the invention.

Figure 6:
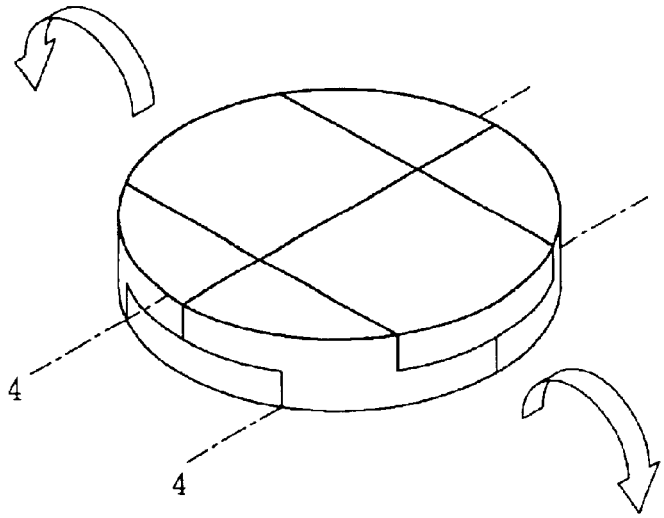
FIG. 6 is a perspective view of another configuration of the structure.
Figure 7A:
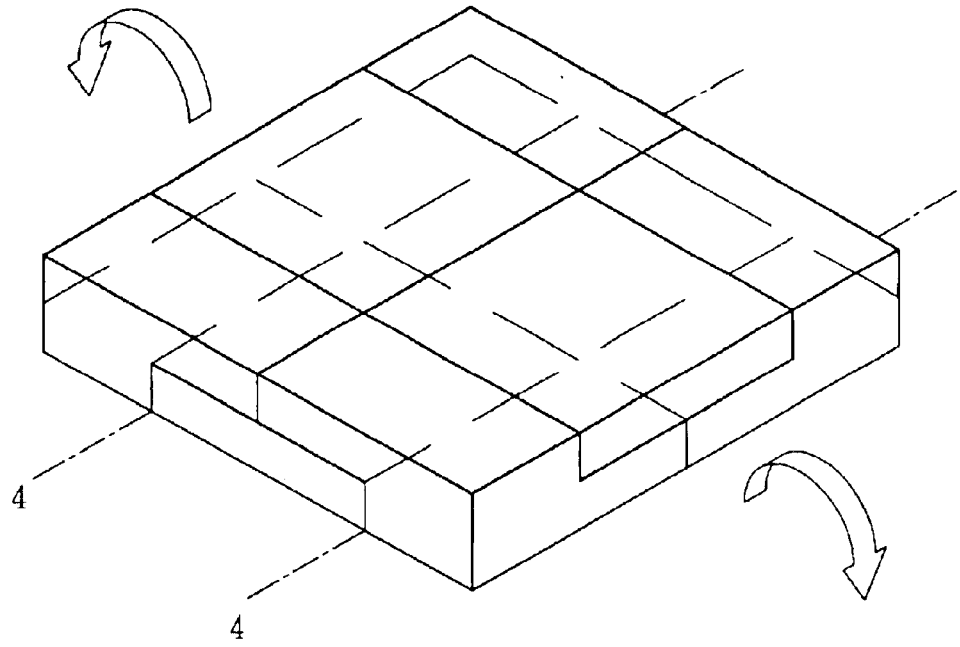
FIGS. 7*a*, 7*b*, 7*c*, and 7*d* are perspective views of a second preferred embodiment of double layer block structure according to the invention for illustrating first, second, third, and fourth shapes thereof respectively.
Figure 7B:
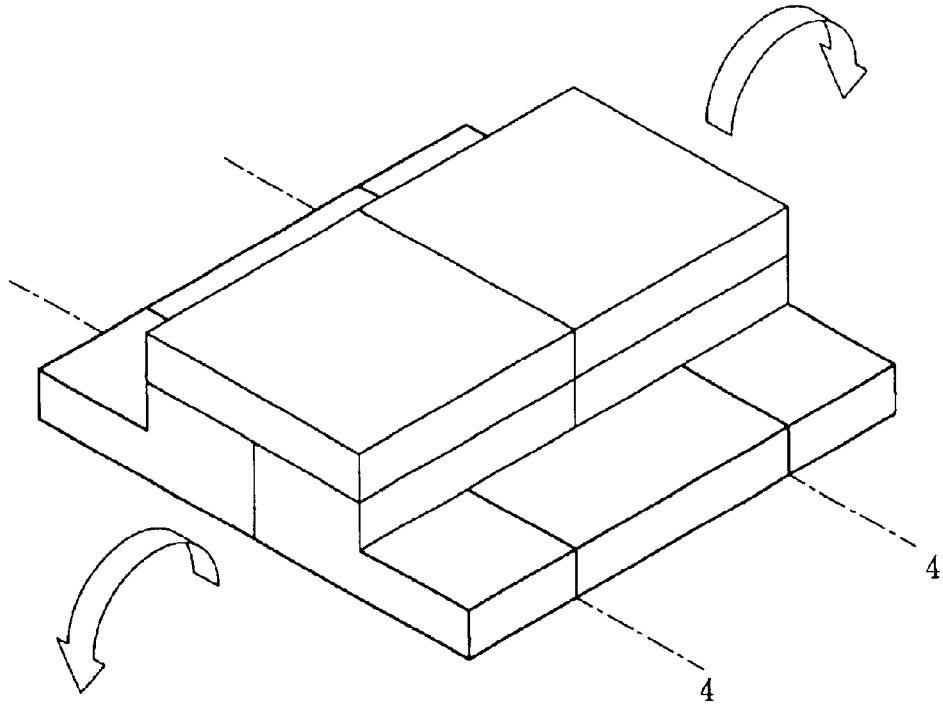
Figure 7C:
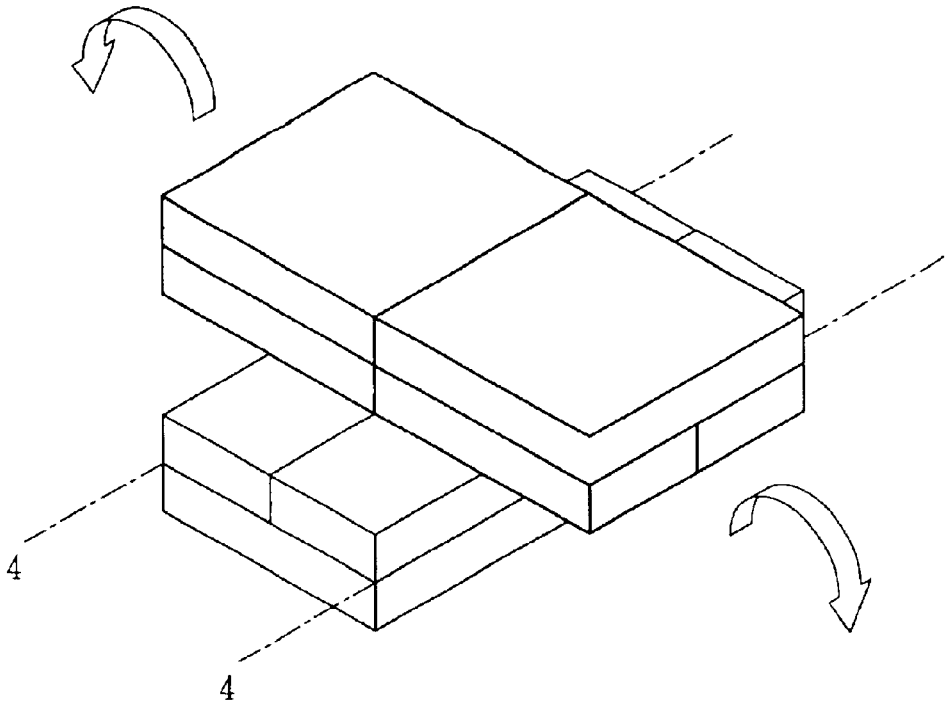
Figure 7D:
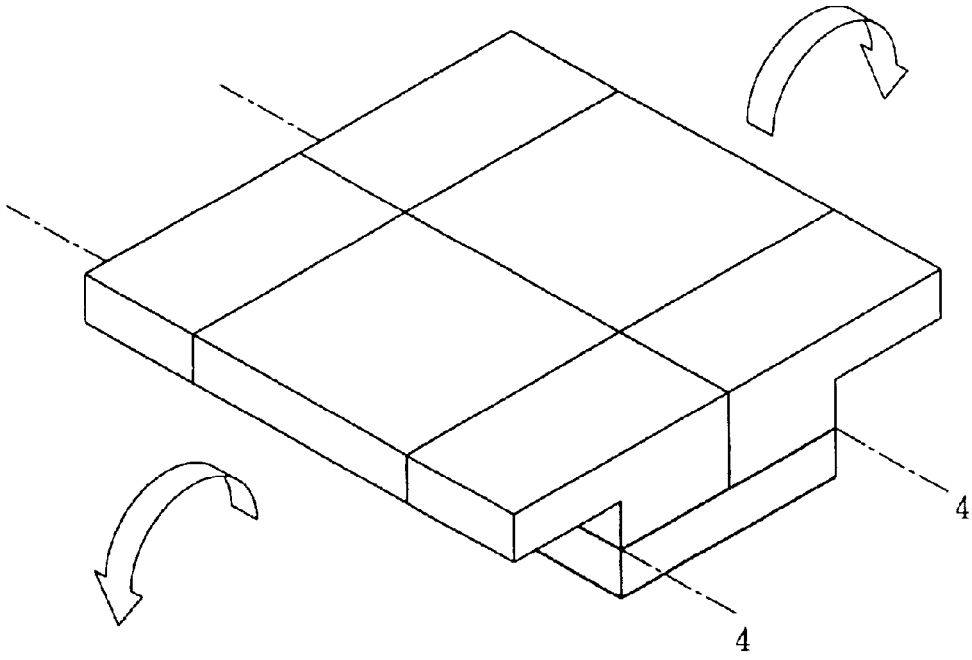

In the first, third, fifth, or seventh shape, it is possible to change the axis 4. In other words, it is possible to not only change into the second, fourth, sixth, and eighth shapes by turning but also to return to the eighth, second, fourth, and sixth shapes by turning. FIGS. 2*a* and 6 show the structure in the first shape. The structure will form the second shape by turning about the axis 4 in FIG. 2*a*. Alternatively, the structure will form the eighth shape by turning about the axis 4 in FIG. 6.

Figure 4A:
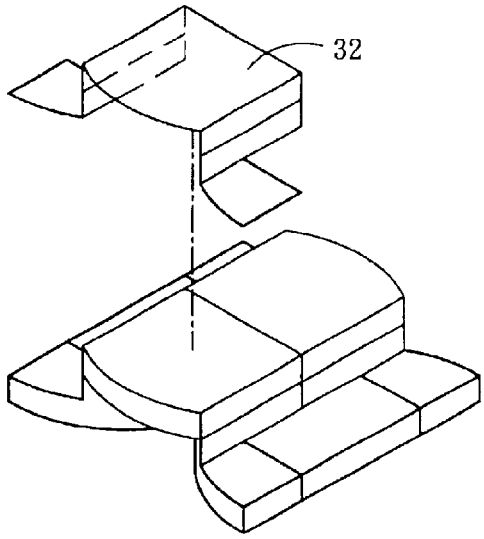
FIGS. 4*a* and 4*b* are perspective views showing the sticker to be adhered to the blocks in the seventh and eighth shapes respectively.
Figure 4B:
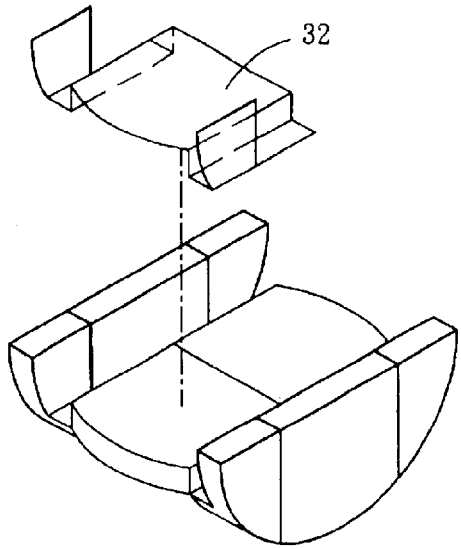
Figure 4C:
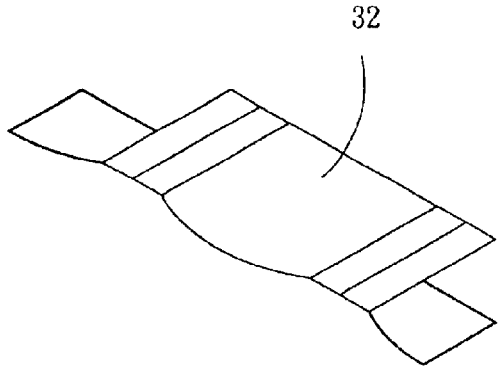
FIG. 4*c* is a perspective view of the expanded sticker shown in FIG. 3.
Figure 5A:
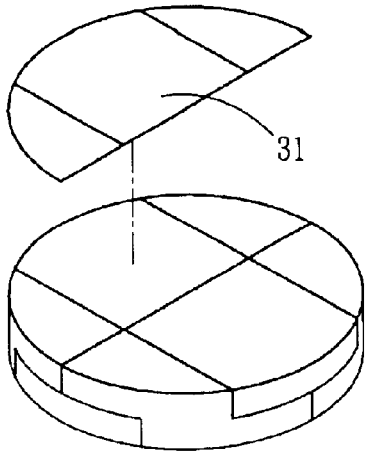
FIGS. 5*a* and 5*b* are perspective views showing the sticker to be adhered to the blocks in the first and second shapes respectively.
Figure 5B:
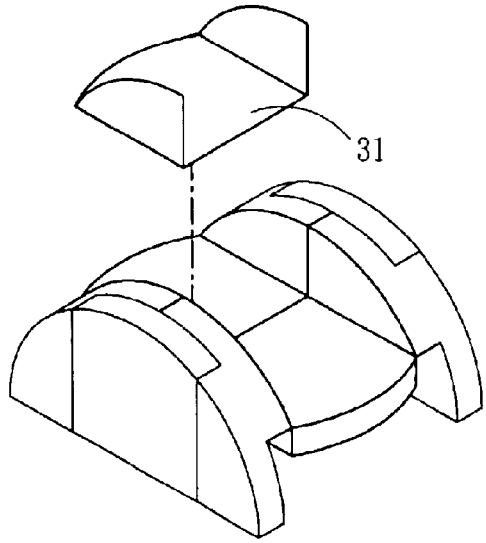

Referring to FIGS. 4*a* and 4*b*, which are perspective views showing the sticker to be adhered to the blocks in the seventh and eighth shapes respectively. FIG. 4*c* is a perspective view of the expanded sticker shown in FIG. 3.

FIGS. 7*a* to 7*d* are perspective views of a second preferred embodiment of a double layer block structure according to the invention for illustrating first, second, third, and fourth shapes thereof respectively. In this embodiment, the original structure is a parallelepiped having a square shape viewed from either the top or the bottom. The turning direction of the second embodiment is opposite to that of the first embodiment. But both can turn repeatedly. Also, different combinations of the inner stickers and the outer stickers can be formed in different shapes by turning in either embodiment.

While the invention herein disclosed has been described by means of specific embodiments, numerous modifications and variations could be made thereto by those skilled in the art without departing from the scope and spirit of the invention set forth in the claims.

What is claimed is:

1. A double layer block assembly, comprising:

four single layer blocks;

two first double layer blocks;

two second double layer blocks;

four outer stickers; and four inner stickers, wherein an upper layer section of the assembly comprises two of the four single layer blocks, two upper layers of the two first double layer blocks, and two upper layers of the two second double layer blocks;

wherein a lower layer section of the assembly comprises another two of the four single layer blocks, two lower layers of the two first double layer blocks, and two lower layers of the two second double layer blocks;

wherein the four outer stickers are respectively adhered to a top and a bottom surfaces of the assembly; and wherein the four inner stickers are adhered between the upper layer section and the lower layer section of the assembly so that the assembly is operative to repeatedly turn about two parallel axes.

2. The double layer block assembly of claim 1, wherein the two upper layers of the two first double layer blocks and the two upper layers of the two second double layer blocks of the upper layer section are disposed at opposite sides of the two single layer blocks of the upper layer section.

3. The double layer block assembly of claim 1, wherein the two lower layers of the two first double layer blocks and the two lower layers of the two second double layer blocks of the lower layer section are disposed at opposite sides of the two single layer blocks of the lower layer section.

4. The double layer block assembly of claim 1, wherein the axes are disposed at opposite sides of either the two single layer blocks of the upper layer section or the two single layer blocks of the lower layer section.

5. The double layer block assembly of claim 4, wherein the axes disposed at opposite sides of the two single layer blocks of the upper layer section are perpendicular to the axes disposed at opposite sides of the two single layer blocks of the lower layer section.

6. The double layer block assembly of claim 1, wherein two of the four outer stickers are adhered to a top surface of the upper layer section and another two of the four outer stickers are adhered to a bottom surface of the lower layer section.

7. The double layer block assembly of claim 6, wherein each of the outer stickers are adhered to one of the single layer blocks, one of the first double layer blocks, and one of the second double layer blocks.

8. The double layer block assembly of claim 1, wherein two of the four inner stickers are adhered to a bottom surface of the upper layer section and another two of the four inner stickers are adhered to a top surface of the lower layer section.

9. The double layer block assembly of claim 8, wherein each of the inner stickers are adhered to one of the single layer blocks, one of the first double layer blocks, one of the second double layer blocks, and contact sides thereof.

10. The double layer block assembly of claim 1, wherein the assembly has a shape of a section of a polygon.

11. The double layer block assembly of claim 1, wherein the assembly has a shape of a section of a circle.

12. The double layer block assembly of claim 1, wherein the assembly has a shape of a section of a rectangle.

13. The double layer block assembly of claim 1, wherein the assembly has a shape of a section of a oval.

* * * * *